US007095407B1

(12) United States Patent
Erhart et al.

(10) Patent No.: US 7,095,407 B1
(45) Date of Patent: Aug. 22, 2006

(54) METHOD AND APPARATUS FOR REDUCING NOISE IN A GRAPHICS DISPLAY SYSTEM

(75) Inventors: Richard Alexander Erhart, Tempe, AZ (US); Bruce C. Moore, Glendale, AZ (US); Donald E. Camp, Peoria, AZ (US); Mark Kuhns, Peoria, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 346 days.

(21) Appl. No.: 10/424,223

(22) Filed: Apr. 25, 2003

(51) Int. Cl.
*G06G 5/00* (2006.01)

(52) U.S. Cl. ..... 345/213; 345/204

(58) Field of Classification Search ..... 345/204, 345/545–551, 520, 211–213
See application file for complete search history.

(56) References Cited

U.S. PATENT DOCUMENTS

| | | | | |
|---|---|---|---|---|
| 5,745,093 | A * | 4/1998 | Tsuzuki et al. | 345/103 |
| 5,892,496 | A * | 4/1999 | Wakeland | 345/694 |
| 6,307,531 | B1 * | 10/2001 | Shin | 345/88 |
| 6,448,951 | B1 * | 9/2002 | Sakaguchi et al. | 345/88 |
| 2003/0043132 | A1 * | 3/2003 | Nakamura | 345/204 |
| 2003/0095124 | A1 * | 5/2003 | Tjandrasuwita | 345/538 |

* cited by examiner

*Primary Examiner*—Alexander Eisen
(74) *Attorney, Agent, or Firm*—Darby & Darby PC; Matthew M. Gaffney

(57) ABSTRACT

The present invention is related to staggering data to reduce noise in a graphics display system. Line-to-line data staggering is achieved by staggering the starting point at which data is transmitted within each line of data. Frame-to-frame staggering is implemented by staggering the starting point of the first line of data from its value in the previous frame by a predetermined value each frame. Alternatively, frame-to-frame data staggering can be performed every other frame instead of every frame.

31 Claims, 6 Drawing Sheets

FIG. 4A

LINE-TO-LINE DATA STAGGER DISABLED

| | | | | |
|---|---|---|---|---|
| LINE 1: | ...HEADER... | DATA TOKEN 1 | DATA TOKEN 2 | ... | DATA TOKEN 32 |
| LINE 2: | ...HEADER... | DATA TOKEN 1 | DATA TOKEN 2 | ... | DATA TOKEN 32 |
| LINE 3: | ...HEADER... | DATA TOKEN 1 | DATA TOKEN 2 | ... | DATA TOKEN 32 |
| | ⋮ | ⋮ | ⋮ | ⋮ | ⋮ |
| LINE 768: | ...HEADER... | DATA TOKEN 1 | DATA TOKEN 2 | ... | DATA TOKEN 32 |

FIG. 4B

LINE-TO-LINE DATA STAGGER = 7

| | | | | |
|---|---|---|---|---|
| LINE 1: | ...HEADER... | DATA TOKEN 1 | DATA TOKEN 2 | ... | DATA TOKEN 32 |
| LINE 2: | ...HEADER... | DATA TOKEN 8 | DATA TOKEN 9 | ... | DATA TOKEN 7 |
| LINE 3: | ...HEADER... | DATA TOKEN 15 | DATA TOKEN 16 | ... | DATA TOKEN 14 |
| | ⋮ | ⋮ | ⋮ | ⋮ | ⋮ |
| LINE 768: | ...HEADER... | DATA TOKEN 26 | DATA TOKEN 27 | ... | DATA TOKEN 25 |

METHOD AND APPARATUS FOR REDUCING NOISE IN A GRAPHICS DISPLAY SYSTEM

FIELD OF THE INVENTION

The present invention relates to graphics display systems, and, in particular, to a method and apparatus for staggering data to reduce correlated noise in a graphics display system.

BACKGROUND OF THE INVENTION

Graphics display systems receive digital video signals and display graphics data on a display. The graphics display system consists of electronics that accept the digital video signals, format the signals for the display, and drive the display with analog voltages that correspond to the formatted digital video signals.

Electrical noise in a graphics display system can result in visual artifacts on the display. In many systems, digital data is used to generate analog voltages (e.g. RGB signals) that are driven to the display. The analog voltages are generated via digital-to-analog converters (DACs). Noise can corrupt the analog voltages that are driven to the display and/or the digital data. The noise can result in visual artifacts. Visual artifacts may include lines or dots on the display for correlated noise events. Uncorrelated noise events may have other types of visual artifacts on the display.

BRIEF DESCRIPTION OF THE DRAWINGS

FIGS. 4A and 4B illustrate an example data transmission protocol, in accordance with aspects of the present invention.

DETAILED DESCRIPTION OF THE PREFERRED EMBODIMENT

Figure 1:
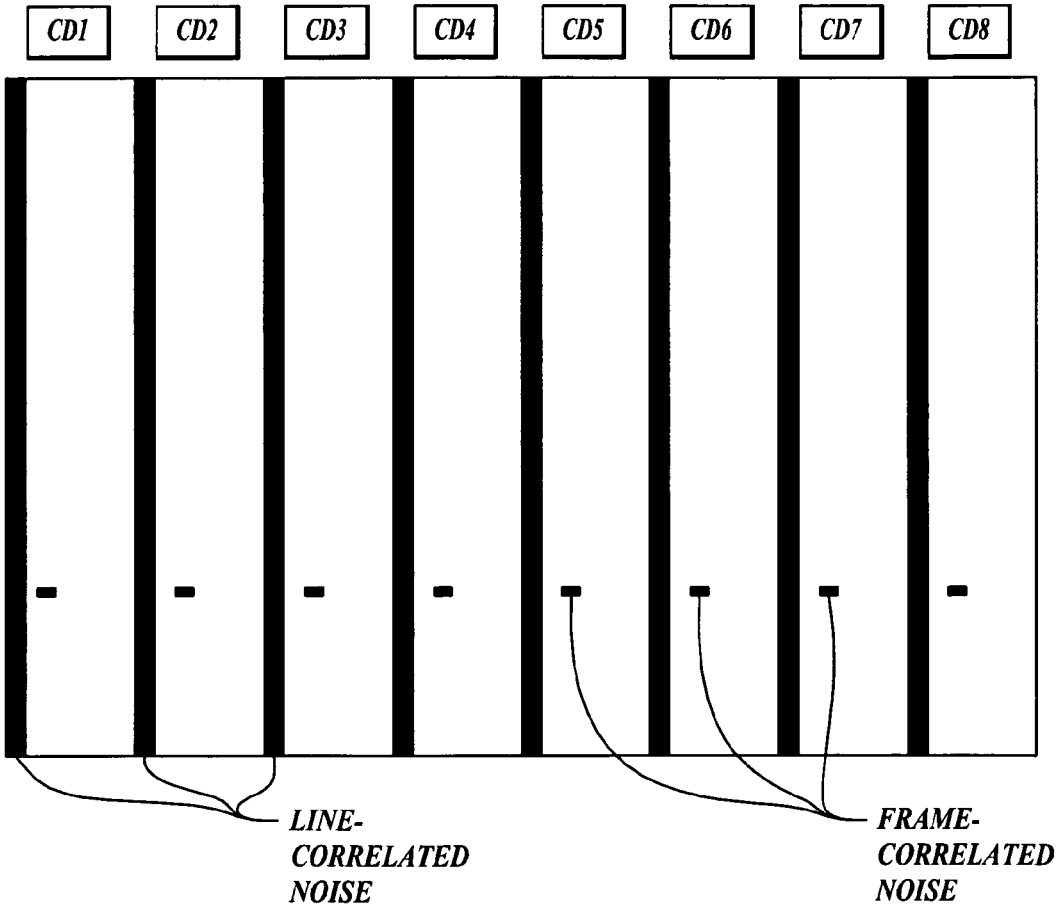
FIG. 1 illustrates effects of correlated noise events on a visual display.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, or data signal. Referring to the drawings, like numbers indicate like parts throughout the views.

Overview

The invention is related to reducing noise in a graphics display system by data staggering. Data may be staggered by staggering the starting position of each line on a line-to-line basis. Data may also be staggered by staggering the starting position of each frame on a frame-by-frame basis. Alternatively, rather than staggering the position of each frame, every other frame may staggered. The starting position of each frame is repeated once before staggering the frame when every other frame is staggered.

The invention is related to reducing or eliminating correlated noise in a video display system. The noise may be correlated with the horizontal frame rate and/or the vertical frame rate of the video display system. Examples of correlated noises on a display are illustrated in FIG. 1. In a first example (line-correlated noise), the noise events are correlated with the same point in time relative to the horizontal frame rate. The invention may also reduce or eliminate uncorrelated noise in a video display system.

For the first example (line-correlated noise), the correlated noise is manifested as a series of vertical bars on the display, where each vertical bar is associated with a particular column driver of the display. In a second example (frame-correlated noise), the noise events occur at the same point in time relative to the vertical frame rate. For the second example (frame-correlated noise), the noise is manifested as a number of smeared dots on the display, where the smeared dots appear in a particular row on the display. Each smeared dot is associated with a particular column driver of the display. In still another example, correlated noise events may occur at a frequency that is different from the line rate, resulting in a series of diagonal stripes or other geometric shapes (not shown).

Example System

Figure 2:
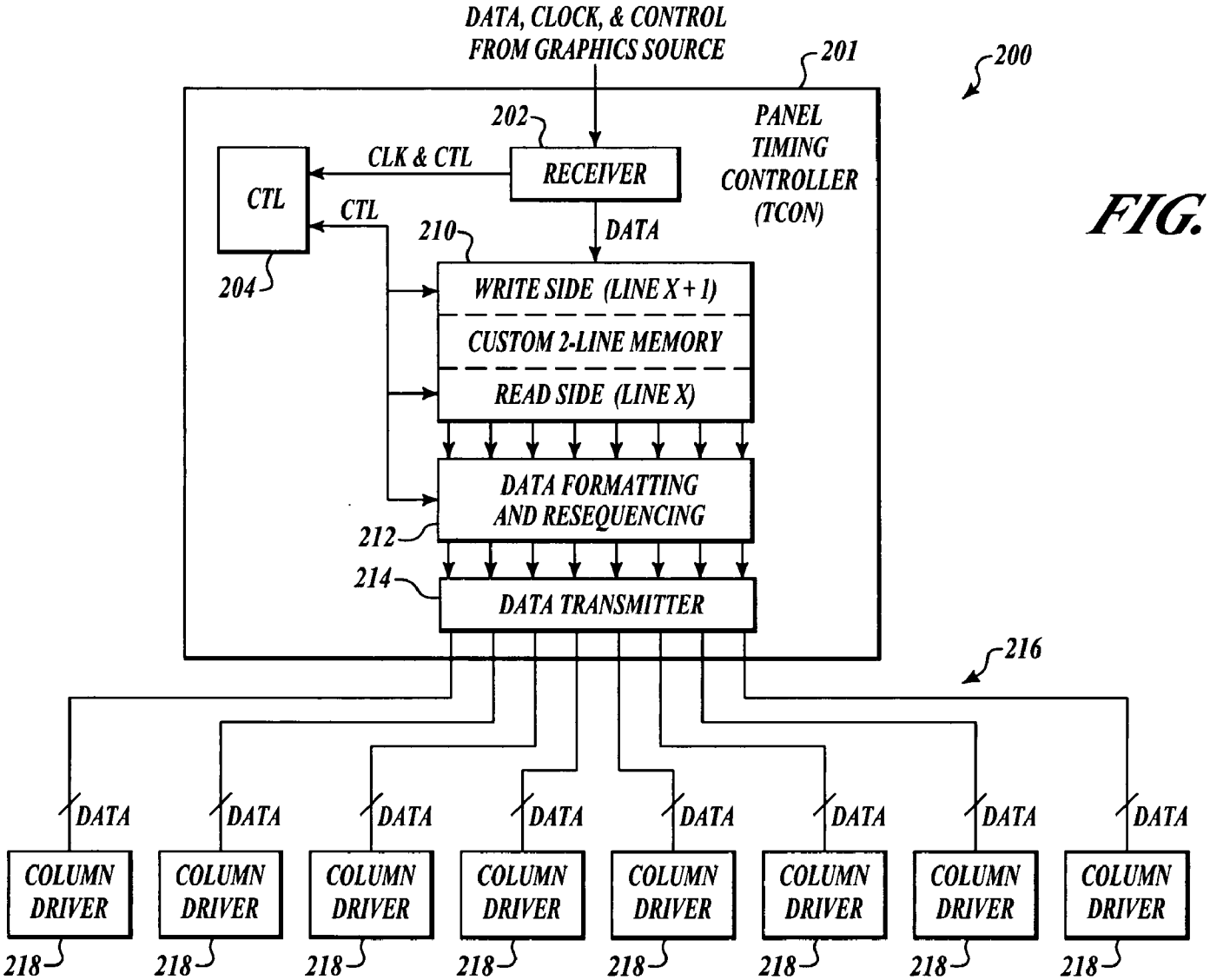
FIG. 2 illustrates an example graphics control system that is arranged in accordance with aspects of the present invention.

FIG. 2 illustrates an example graphics display system (200) that is arranged in accordance with aspects of the present invention. Graphics display system 200 includes a timing controller (TCON, 201), a graphics display bus (216), and column drivers (218). TCON 201 includes receiver 202, control component 204, memory 210, data formatting and resequencing component 212, and data transmitter component 214.

In operation, receiver 202 receives a clock signal, a control signal, and graphic data from a graphics source. Receiver 202 receives one pixel of graphic data at each clock signal. Receiver 202 sends the graphics data to memory 210. Receiver 210 also sends the clock and control signals to control component 204. Control component 204 provides a control signal to memory 210. Control component 204 also provides a control signal to data formatting and resequencing component 212. Memory 210 stores the graphics data.

Data formatting and resequencing component 212 is arranged to read data from memory 210. The data is read in a resquenced order as resequenced data such that correlated noise will be spread out when it is displayed. For example, the resequenced order may include data staggering. Data staggering may include a line-to-line data stagger, a frame-to-frame data stagger, or both (as will be explained in greater detail below). Data formatting and resequencing component 212 is arranged to provide the resequenced data to data transmitter component 214.

Data transmitter component 214 is arranged to transmit the resequenced data to column drivers 218. The resequenced data is transmitted via graphics display bus 216. Data transmitter component 214 is also arranged to provide information to column drivers 218, regarding the resequenced order. For example, data transmitter component 214 may provide a starting token number. The starting token number indicates which data token is the starting token for the frame. According to another example, the resequenced data and control information is communicated to column driver 218 via graphics display bus 216. The resequenced data and control information is communicating using a serial data transmission protocol. The control information may include the starting token number. Column drivers 218 are arranged to drive the displaying, starting with the column that corresponds to the starting token.

Some graphics display systems incorporate resistor based digital-to-analog converters (RDACs) in each column driver (218). The RDACs convert digital RGB signals to analog equivalents based on weighting in the resistor network. Other graphics display systems may include architectures such as sample/hold-based column drivers (218). An architecture that includes sample/hold-based column drivers reduces the number of RDACs required by sharing RDACs with more than one column driver. The order of digital-to-analog conversion and sampling can be altered (e.g. staggered) to de-correlate noise events.

In the example shown in FIG. 2, the resequencing is performed as data is read from memory 210 by data formatting and resequencing component 212. Alternatively, the resequencing may be performed as data is: read into receiver 202, sent from the receiver to the memory, sent to the data transmitter component 214, or sent out from the data transmitter component 214. The resequencing can occur at any point in processing, as long as information about the resequencing is conveyed to column drivers 218. For example, information about the resequencing in a data transmission protocol can be provided to column drivers 218.

There are several ways that data can be resequenced to reduce correlated noise in accordance with aspects of the present invention. Line-to-line data staggering is one method to reduce correlated noise in a graphics display system. Frame-to-frame data staggering is another method to reduce correlated noise in a graphics display system.

Line-to-Line Data Staggering

Line-to-line data staggering is described as follows below.

The starting point for each subsequent line is transmitted in a different sequence in line-to-line data staggering. Memory 210 is arranged to store an entire line of data for the display. The starting point is arithmetically staggered (for example, incremented or decremented by the same amount) according to a modulo arithmetic function. For each subsequent line, the starting token is calculated using the line number (i.e., the row in the display) as a seed. For each particular line, the data is processed in column sequential order beginning at the starting token, and wrapping around to the first column. The line-to-line staggering method will be described in further detail with reference to FIG. 4B.

Figure 3:
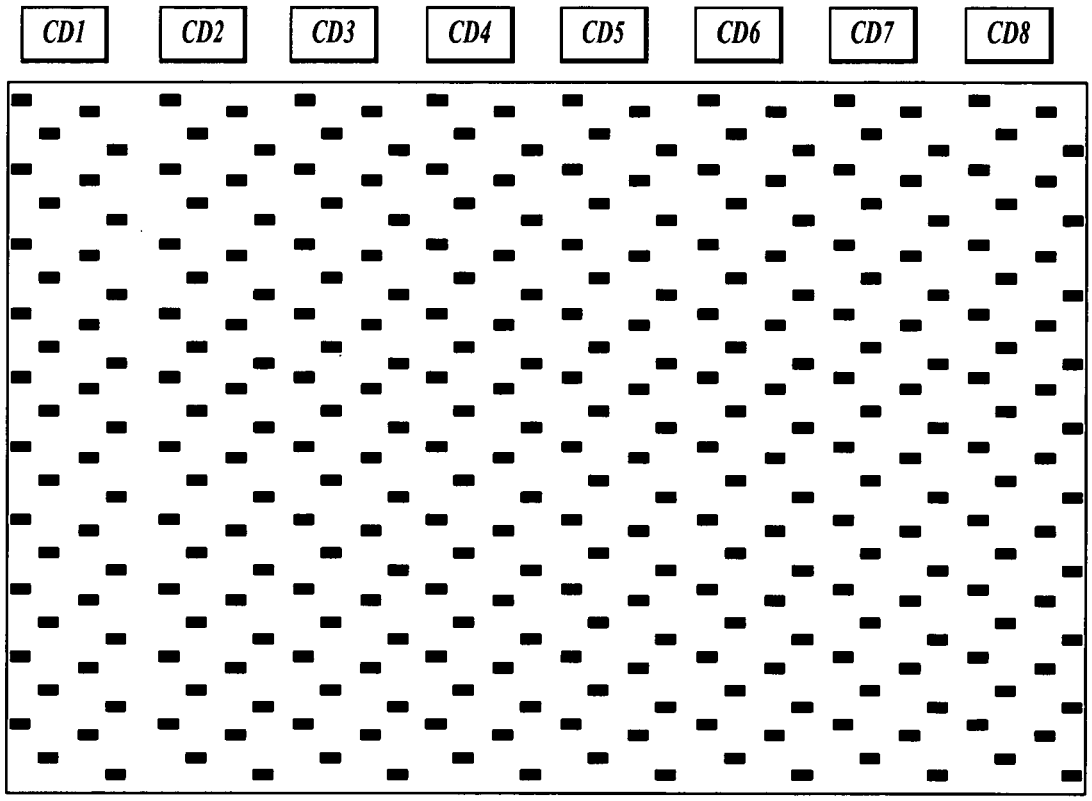
FIG. 3 illustrates the effect of line-to-line data staggering on a visual display, according to aspects of the present invention.

Line-to-line data staggering has the effect of spatially dispersing the visual noise artifacts over a larger area of the display. Spatial dispersion of the visual noise artifacts for the line-correlated noise of FIG. 1 is illustrated in FIG. 3. Line-to-line data staggering causes the noise on the display to have a much lower average spatial frequency. Because the noise has a much lower spatial frequency, pixels affected by the noise are spread as far apart from one another as possible. Noise is preferable dispersed across the display in a uniform fashion. Uniform dispersion of the noise prevents clumping of the noise, which may occur when random or pseudo-random line-to-line data staggering is applied. Clumped noisy pixels are more apparent to the human eye. Dispersion of noise can alternatively be accomplished in a non-uniform fashion.

FIGS. 4A and 4B illustrate an example data transmission protocol, in accordance with aspects of the present invention. Line-to-line staggering can be performed by providing data in a staggered sequence on a line-by-line basis. For each horizontal line (or row), the data is communicated in a staggered sequence from TCON 201 to column drivers 218. The data for each horizontal line is subdivided into groups referred to as data tokens. Each data token only contains pixel information. Additional information may be contained in a header. An example header may contain the starting token number for the display line.

In the example illustrated in FIGS. 4A and 4B, a token is selected as 96 bits, or four 24-bit pixels of red/green/blue (RGB) in a 1024 column display. Therefore, 32 tokens of data are transmitted in each line. When data stagger is disabled, the tokens are sent in increasing order starting at token 1 on each line, as shown in FIG. 4A.

Line-to-line data staggering is preferably implemented as follows below. The starting token number is incremented by a line stagger increment that is selected to provide the lowest spatial frequency that can be obtained. The token is incremented for each subsequent line within a given frame. The value for the token is a result of the modulo arithmetic function (e.g., $f(x)=(1+(x-1)*\text{stagger}) \bmod (\text{tokens per line})$). In the example illustrated in FIG. 4B, the line-to-line data stagger increment is selected 7, where line 1 has a starting token of 1, line 2 has a starting token of 8, line 3 has a starting token of 15, and so forth. In the example shown in FIG. 4B, the starting token is determined using a modulo 32 function. Because the starting token is incremented using a modulo 32 function, when it is incremented above 32, the starting token wraps around to 1.

In the example illustrated in FIG. 4B, TCON 201 communicates to column drivers 218 the starting token number for the line. TCON 201 can communicate the starting token number using a serial protocol or using some other means of selecting the data transmission order.

Frame-to-Frame Data Staggering

Another way to resequence data to reduce noise is using frame-to-frame data staggering, as will be described below.

The starting point of the first line of data is staggered from the starting point that the first line had in the previous frame by a predetermined value each frame. According to one example, frame-to-frame staggering only affects the starting point of the first line of data in each frame. The starting point of subsequent lines in the frame is determined by the line-to-line stagger value.

TCON 201 is configured to communicate the starting point of the data to column drivers 218. For example, TCON 201 may be configured to communicate a starting token number for the line to column drivers 218. The starting token number of every line within the frame is the same. However, the starting token number is advanced with each subsequent frame in a modulo arithmetic fashion.

A vertical "scrolling" of the spatial dispersion pattern is being performed. The spatial dispersion pattern preferably scrolls fast enough to avoid visual detection by evenly dispersing the visual noise artifacts on the display over time, which is defined as temporal dispersion.

Combination Data Staggering

Frame-to-frame and line-to-line staggering techniques can be combined together such that visual artifacts are minimized by using both spatial and temporal dispersion. An example of combination data staggering is described below with reference to FIG. 5.

Figure 5:
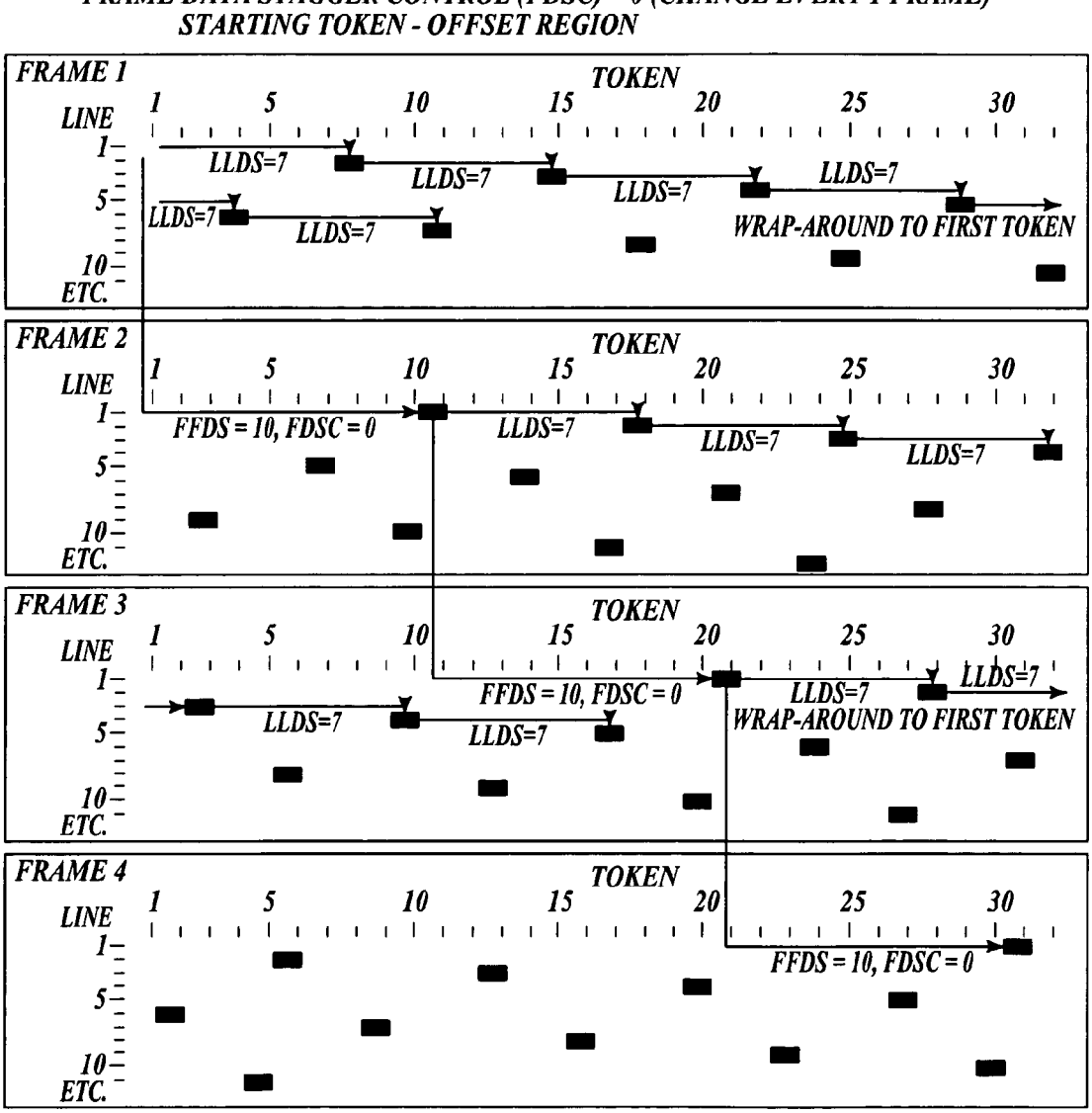
FIG. 5 illustrates frame-by-frame effects of frame-to-frame data staggering, according to aspects of the present invention.

FIG. 5 illustrates the effect of a frame-to-frame data stagger increment of 10, with a line-to-line data stagger increment of 7. The frame-to-frame data stagger increment of 10 in combination with the line-to-line data stagger increment of 7 effectively makes the frame appear to scroll upward six lines each frame, as seen in FIG. 5. The filled squares and arrows illustrate the movement of data token 1 both line-to-line and frame-to-frame. The resulting data pattern that occurs when the frames are overlaid is related to temporally averaging the noise pattern as evenly as possible over all pixels in the display.

The optimal parameters for combination data staggering is system implementation specific. The best combination of frame-to-frame and line-to-line values may have a high greatest common denominator relative to the number of data tokens per line and its submultiples of two. According to one preferred embodiment, there are 32 tokens per line, a line-to-line stagger increment of 7, and a frame-to-frame stagger increment of 10, which has the effect of scrolling the frame up by 6 lines each frame. Other combinations are considered within the scope of the present invention, and may provide optimal results depending on the overall system implementation.

In one embodiment, line-to-line and frame-to-frame data staggering is implemented by using separate counters for each staggering parameter. One counter may be used with a programmed value for the line-to-line stagger. The other counter may be used for the frame-to-frame stagger. According to one example, the line-to-line stagger value is added to every line except for the first line of the frame. At the first line of the frame, line-to-line stagger value is ignored and the frame-to-frame stagger increment is added instead. Subsequent lines use the line-to-line stagger value by incrementing the line-to-line token counter for each additional line. Line-to-line and frame-to-frame staggers are preferably controlled independently from each other.

Frame Staggering with Repeated Frames

The starting position of a frame may be incremented every other frame rather than every frame. This may be preferable for liquid crystal displays (LCDs) that implement frame inversion.

Frame inversion is used to prevent image retention. Liquid crystal displays (LCDs) are degraded when subject to a long-term DC potential. A long-term DC potential across pixel electrodes creates an electric field. The electric field causes electroplating of ion impurities in the liquid crystal onto the electrodes. Electroplating of the ion impurities creates a residual field on the pixel electrodes. The residual field causes image retention on the display.

On LCD displays that implement frame inversion, drive voltages have a DC component of approximately zero in order to minimize degrading of the LCD display. Each pixel is driven with alternating drive voltages. The alternative drive voltages provide the RMS voltage value to display an image while maintaining an approximately zero average voltage on the pixel. A pixel has approximately the same brightness when it is driven at the same magnitude at the opposite polarity. The column output voltage is determined by an inverse gamma curve. Each column is driven on alternating halves of the inverse gamma curve each frame.

For noise sources that are correlated with the line rate, the error that results from noise for a given line of a frame will be on the opposite half of the gamma curve in the next frame. The error induced by the noise has the opposite effect on the display when the column is being driven in the lower half of the inverse gamma curve than it does when driving in the upper half of the gamma curve. Therefore, it may be preferable to not stagger the starting token each frame. The starting token may be staggered every other frame instead. A frame is repeated once before staggering the starting token.

Alternatively, staggering every frame may be preferable. Staggering every frame may be preferable because staggering every other frame causes the pattern to be displayed at half the original rate. Displaying the pattern at half the original rate may reduce the frame rate to be within the range visible to the human eye. Reducing the frame rate within a range visible to the human eye may result in a visible flickering effect.

Example Embodiment of Data Staggering Process

Figure 6:
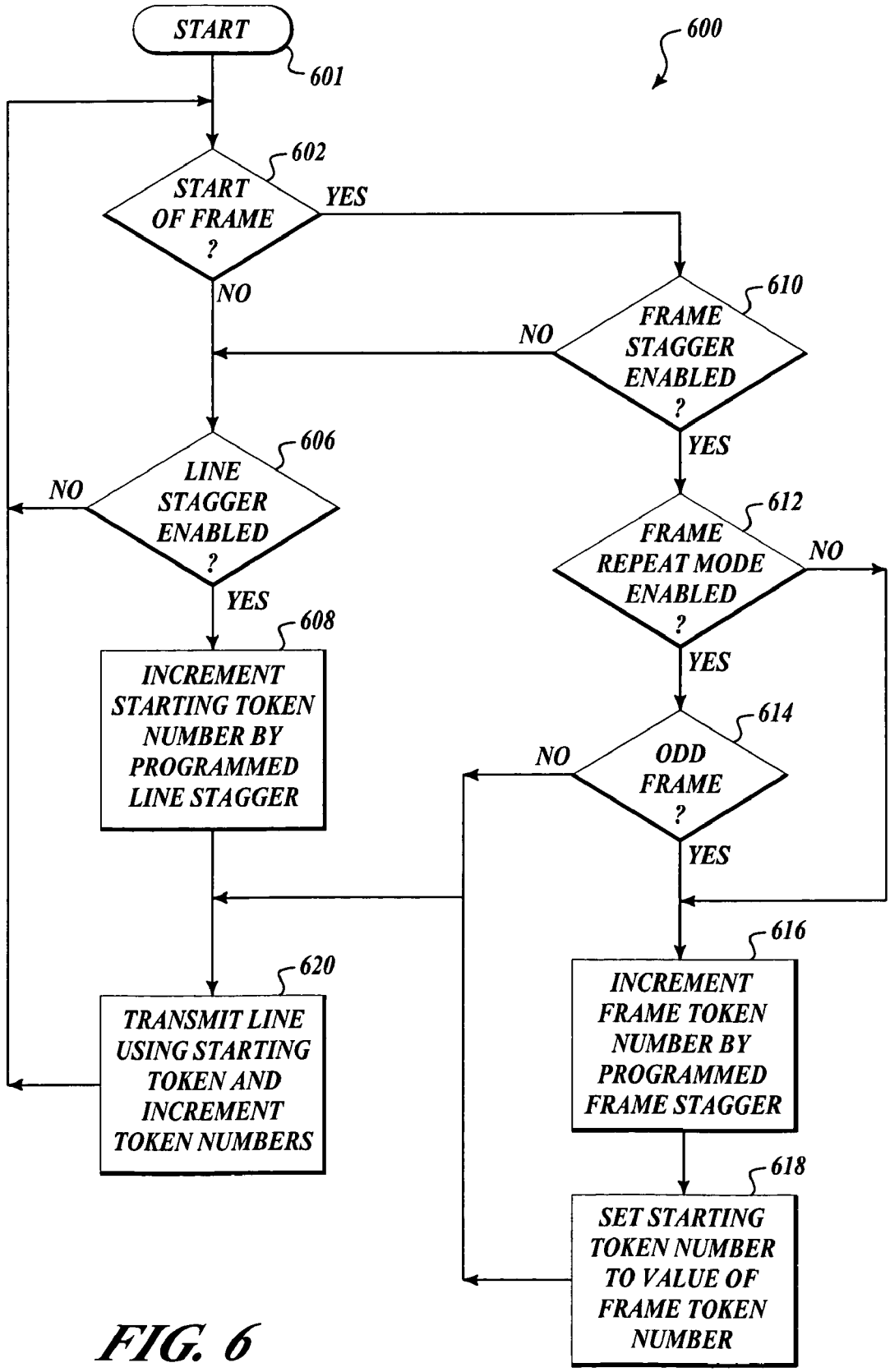
FIG. 6 is a flow chart that illustrates an example data staggering process, according to aspects of the present invention.

FIG. 6 illustrates an example data staggering process (600), according to aspects of the present invention.

After start block 601, process 600 proceeds to decision block 602. At decision block 602, it is evaluated whether the next line to be transmitted to the column drivers is the first line of the current frame. Process 600 proceeds from decision block 602 to decision block 610 when the next line to be transmitted is the first line of the current frame. Alternatively, process 600 proceeds from decision block 602 to decision block 606 when the next line to be transmitted is not the first line of the current frame.

At decision block 606, it is evaluated whether line-to-line data staggering is enabled. Process 600 proceeds from decision block 606 to block 608 when line-to-line data staggering is enabled. Alternatively, process 600 proceeds from decision block 606 to decision block 602 when line-to-line data staggered is not enabled or has not been implemented in the particular embodiment of process 600 that is being used.

At block 608, the starting token number is incremented by a pre-determined line stagger increment. The process then proceeds from block 608 to block 620. At block 620, the current line and the starting token number are transmitted to column driver 218 via graphics display bus 216, and the token numbers are incremented by an amount corresponding to the starting token number. Process 600 then proceeds from block 620 to decision block 602.

At decision block 610, it is evaluated whether frame stagger is enabled. Process 600 proceeds from decision block 610 to decision block 612 when frame stagger is enabled. Alternatively, process 600 proceeds from decision block 610 to decision block 604 when frame stagger is not enabled or has not been implemented in the particular embodiment of process 600 that is being used.

At decision block 612, it is evaluated whether frame repeat mode has been enabled. Process 600 proceeds from decision block 612 to decision block 614 when frame repeat mode has been enabled. Alternatively, process 600 proceeds from decision block 612 to block 616 when frame repeat mode has not been enabled or has not been implemented in the particular embodiment of process 600 that is being used. At block 616, the frame token number is incremented by a predetermined frame stagger increment. The process then proceeds from block 616 to block 618. At block 618, the starting token number is set to the value of the frame token number. Process 600 then proceeds from block 618 to block 620.

At decision block 614, it is evaluated whether the frame token number was incremented during the last frame. Process 600 proceeds from decision block 614 to block 620 when the frame token number was incremented during the last frame. Alternatively, process 600 proceeds from decision block 614 to block 616 when the frame token number was not incremented during the last frame.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for reducing noise in a graphics display system, the method comprising:

storing a line of data, wherein the data is organized according to columns;

selecting a sequencing order for the columns of the stored line;

applying the sequencing order to the data of the stored line to provide a sequenced line;

communicating information about the selected sequencing order to column drivers; and transmitting the sequenced line to the column drivers, wherein the sequenced line is suitable for a color display, wherein the information about the selected sequencing order is communicated to the column drivers according to a data transmission protocol, the sequenced line has a starting token number that is specified in the data transmission protocol, and the starting token number is associated with a staring column number from the stored line of data.

2. The method as in claim 1, wherein the information about the selected sequencing order is communicated to the column drivers according to a data transmission protocol.

3. The method as in claim 1, applying the sequencing order further comprising: applying a modulo arithmetic function to the stored line.

4. The method as in claim 1, wherein applying the sequencing order comprises staggering the starting data position of each stored line to provide the sequenced line, wherein the starting data position is determined according to the selected sequencing order, and wherein communicating information comprises communicating a starting token number for the sequenced line to the column drivers.

5. The method as in claim 1, wherein applying the sequencing order comprises staggering the start data position of each stored line on a line-by-line basis, and wherein communicating information comprises communicating a starting data position for the frame to the column drivers.

6. The method as in claim 1, wherein applying the sequencing order comprises staggering the starting data position for each stored line on an alternating frame basis, such that the sequencing order is changed on alternate frames, and wherein communicating information comprises communicating a starting data position for the frame to the column drives.

7. The method as in claim 1, wherein applying the sequencing order comprises:

offsetting a starting token associated with the data for the stored line by a line stagger amount; and adjusting the line stagger amount by a predetermined line stagger increment for each subsequent stored line.

8. The method as in claim 1, wherein applying the sequencing order comprises:

evaluating whether the stored line is a first line in frame;

adjusting a frame stagger amount by a predetermined frame stagger increment when the stored line is the first line in the frame; and offsetting a starting token associated with the data for the stored line according to the frame stagger amount.

9. The method as in claim 1, wherein applying the sequencing order comprises:

evaluating whether the stored line is a first line in a frame;

determining whether a frame stagger amount was changed in the last frame;

adjusting the frame stagger amount by a predetermined frame stagger increment when the stored line is the first line in the frame and the frame stagger amount was not changed in the last frame; and offsetting a starting token associated with the data for the stored line according to the frame stagger amount.

10. The method as in claim 1, wherein applying the sequencing order comprises:

evaluating whether the stored line is a first line in a frame;

adjusting a frame stagger amount by a predetermined frame stagger increment when the stored line corresponds to the first line in the frame;

offsetting a starting token associated with the data for the stored line by the frame stagger amount when the stored line is the first line in the frame;

offsetting a starting token associated with the data for the stored line by a combination of a line stagger amount and the frame stagger amount when the stored line is different from the first line in the frame; and adjusting the line stagger amount by a predetermined line-stagger increment for each stored line that is subsequent to the first line in the frame.

11. The method as in claim 1, wherein applying the sequencing order comprises:

determining whether a frame stagger amount was changed in the last frame;

evaluating whether a stored line is a first line in a frame;

adjusting a frame stagger amount by a predetermined frame stagger increment when the stored line is the first line in the frame and the fame stagger amount was not changed in the last frame;

offsetting a starting token associated with the data for the stored line by the frame stagger amount when the stored line is the first line in the frame;

offsetting a starting token associated with the data for the stored line by a combination of a line stagger amount and the frame stagger amount when the stored line is different from the first line in the frame; and adjusting the line stagger amount by a predetermined line-stagger increment for each stored line that is subsequent to the first line in the frame.

12. The method of claim 1, wherein applying the sequencing order includes staggering at least each line except for the first line of the frame by a line stagger increment relative to the preceding line in a modulo arithmetic fashion.

13. The method of claim 1, wherein applying the sequencing order includes staggering each frame by a frame stagger increment relative to the preceding frame in a modulo arithmetic fashion.

14. The method of claim 1, wherein applying the sequencing order includes staggering each alternating frame such that each frame is staggered by a frame stagger increment relative to two frames ago in a modulo arithmetic fashion.

15. The method of claim 1, wherein the stored line of data is a full line of video data, and wherein at least one full line of video data is stored at a time.

16. The method of claim 1, wherein the column drivers are sample/hold based column drivers.

17. The method of claim 1, wherein the stored line of data is digital, and wherein the sequenced line of data is digital.

18. The method of claim 17, wherein the column drivers include a plurality of digital-to-analog converters that are operable to convert the sequenced line of data into a plurality of analog signals, the plurality of analog signals are employed to drive pixels, and wherein each of the pixels includes a red sub-pixel, a green sub-pixel, and a blue sub-pixel.

19. The method of claim 18, wherein the column drivers are sample/hold based column drivers, and wherein each of the plurality of digital-to-analog converters in the column drivers are shared by at least two of the column drivers.

20. A timing controller for a graphics data system with reduced noise, comprising:

a memory that is configured to store graphics data from a graphics source, wherein the graphics data is organized according to columns;

a data formatting and resequencing component that is configured to read data from the memory in a resequenced order as resequenced data; and a data transmitter component that is configured to send the resequenced data to the column drivers via a graphics display bus using a data transmission protocol, wherein the resequenced data is suitable for a color display, wherein the information about the re-sequnced order is communicated to the column drivers in the data transmission protocol, a starting token number is specified in the data transmission protocol for each line, and the stating token number is associated with a starting column number for the line.

21. The timing controller as in claim 20, wherein the resequenced order corresponds to a staggering of the stating position for each line of graphics data according to the starting token, wherein the starting token is changed for each subsequent line within a frame, and wherein the starting token is also changed for each subsequent frame.

22. The timing controller as in claim 20, wherein the resequenced order corresponds to a staggering of the starting position for each line of graphics data according to a starting token, wherein the starting token is changed for each subsequent line within a frame, and wherein the starting token is also changed for every other frame.

23. The timing controller of claim 20, wherein the column drivers are sample/hold based column drivers.

24. The timing controller as in claim 20, wherein the resequenced order corresponds to, for at least each line of a frame after the first line, staggering each line relative to the preceding line in a modulo arithmetic fashion by a line stagger increment.

25. A method for reducing noise in a graphics display system, the method comprising:

storing a line of data, wherein the data is organized according to columns;

selecting a sequencing order for the columns of the stored line;

applying the sequencing order to the data of the stored line to provide a sequenced line;

communicating information about the selected sequencing order to column drivers; and transmitting the sequenced line to the column drivers, wherein the information about the selected sequencing order is communicated to the column drivers according to a data transmission protocol, the sequenced line has a starting token number that is specified in the data transmission protocol, the starting token number is associated with a starting column number from the stored line of data, the sequenced line contains at least 16 data tokens, and wherein each data token includes at least 48 bits.

26. The method of claim 25, wherein each data token is a 96-bit token, wherein the data token includes four 24-bit pixels, and wherein each 24-bit pixel includes a red sub-pixel, a green sub-pixel, and a blue sub-pixel.

27. The method of claim 25, wherein, for more than half of the sequenced lines, the starting token is not the first token in the line, and wherein communicating information about the selected sequence order to the column drivers includes communicating a starting token number for the sequenced line to the column drivers.

28. The method of claim 25, wherein applying the sequencing order includes staggering at least each line except for the first line of the frame by a line stagger increment relative to the preceding line in a modulo arithmetic fashion, and further includes staggering at least a portion of the frames by a frame stagger increment in a modulo arithmetic fraction.

29. The method of claim 28, wherein the frame stagger increment and the line stagger increment have a relatively high greatest common denominator relative to the number of data tokens per line and its submultiples of two.

30. The method of claim 28, wherein each line includes 32 data tokens, the line stagger increment is seven, and the frame stagger increment is ten.

31. A timing controller for a graphics data system with reduced noise, comprising:

a memory that is configured to store graphics data from a graphics source, wherein the graphics data is organized according to columns;

a data formatting and resequencing component that is configured to read data from the memory in a resequenced order as resequenced data; and a data transmitter component that is configured to send the resequenced data to the column drivers via a graphics display bus using a data transmission protocol, wherein the memory is a two line memory including: a write side that stores a full line of the graphics data, wherein the graphics data is digital; and further including a read side that stores a full line of graphics data, such that two lines of the graphics data are stored at one time, and such that the resequenced data is a line of digital video data.

* * * * *

UNITED STATES PATENT AND TRADEMARK OFFICE

CERTIFICATE OF CORRECTION

PATENT NO. : 7,095,407 B1
APPLICATION NO. : 10/424223
DATED : August 22, 2006
INVENTOR(S) : Richard Alexander Erhart et al.

It is certified that error appears in the above-identified patent and that said Letters Patent is hereby corrected as shown below:

In the Claims:

Column 7, Line 35, In Claim 1, delete “staring” and insert -- starting --.

Column 7, Line 51, In Claim 5, delete “staring” and insert -- starting --.

Column 7, Line 61, In Claim 6, delete “drives.” and insert -- drivers. --.

Column 8, Line 44, In Claim 11, delete “fame” and insert -- frame --.

Column 9, Line 35, In Claim 20, delete “stating” and insert -- starting --.

Column 9, Line 38, In Claim 21, delete “stating” and insert -- starting --.

Signed and Sealed this

Twenty-second Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,095,407 B1
APPLICATION NO. : 10/424223
DATED : August 22, 2006
INVENTOR(S) : Richard Alexander Erhart et al.

It is certified that error appears in the above-identified patent and that said Letters Patent is hereby corrected as shown below:

In the Claims:

Column 7, Line 35, In Claim 1, delete “staring” and insert -- starting --.

Column 7, Line 51, In Claim 5, delete “staring” and insert -- starting --.

Column 7, Line 61, In Claim 6, delete “drives.” and insert -- drivers. --.

Column 8, Line 44, In Claim 11, delete “fame” and insert -- frame --.

Column 9, Line 35, In Claim 20, delete “stating” and insert -- starting --.

Column 9, Line 38, In Claim 21, delete “stating” and insert -- starting --.

Signed and Sealed this

Fifth Day of June, 2007

JON W. DUDAS
*Director of the United States Patent and Trademark Office*